US008567024B2

(12) United States Patent
Heinrich et al.

(10) Patent No.: US 8,567,024 B2
(45) Date of Patent: Oct. 29, 2013

(54) DEVICE AND METHOD FOR PRODUCING A UD LAYER

(75) Inventors: Hans-Juergen Heinrich, Chemnitz (DE); Frank Vettermann, Jahnsdorf (DE); Astrid Kirchberg, Chemnitz (DE); Alexander Wegner, Chemnitz (DE); Dietmar Reuchsel, Chemnitz (DE)

(73) Assignee: Karl Mayer Malimo Textilmaschinenfabrik GmbH, Chemnitz (DE)

( * ) Notice: Subject to any disclaimer, the term of this patent is extended or adjusted under 35 U.S.C. 154(b) by 320 days.

(21) Appl. No.: 12/951,623

(22) Filed: Nov. 22, 2010

(65) Prior Publication Data

US 2011/0146040 A1 Jun. 23, 2011

(30) Foreign Application Priority Data

Nov. 27, 2009 (DE) ..... 10 2009 056 197

(51) Int. Cl.
*D01D 11/02* (2006.01)

(52) U.S. Cl.
USPC ..... 28/100; 28/282

(58) Field of Classification Search
USPC ..... 28/100, 102, 282, 283, 172.1, 172.2, 28/192; 19/66 T, 66 R, 157
See application file for complete search history.

(56) References Cited

U.S. PATENT DOCUMENTS

| | | | | |
|---|---|---|---|---|
| 2,244,203 | A * | 6/1941 | Kern | 28/282 |
| 2,771,118 | A * | 11/1956 | Bobkowicz | 156/260 |
| 2,811,770 | A * | 11/1957 | Young, Jr. | 428/114 |
| 3,145,429 | A * | 8/1964 | Resor | 19/157 |
| 3,698,039 | A * | 10/1972 | Kalwaites | 28/103 |
| 3,840,941 | A * | 10/1974 | Neveu | 28/220 |
| 3,953,641 | A * | 4/1976 | Marquis | 428/195.1 |
| 4,421,584 | A * | 12/1983 | Kitagawa et al. | 156/178 |
| 5,214,828 | A * | 6/1993 | Neuert et al. | 28/282 |
| 5,446,952 | A | 9/1995 | Kim et al. | |
| 6,585,842 | B1 * | 7/2003 | Bompard et al. | 156/166 |
| 7,571,524 | B2 | 8/2009 | Kawabe et al. | |
| 2003/0141010 | A1 * | 7/2003 | Pratt | 156/177 |
| 2003/0148082 | A1 * | 8/2003 | Bompard et al. | 428/292.1 |
| 2003/0172506 | A1 * | 9/2003 | Guirman et al. | 28/282 |
| 2010/0078851 | A1 * | 4/2010 | Tam et al. | 264/210.8 |

FOREIGN PATENT DOCUMENTS

| | | |
|---|---|---|
| DE | 197 07 125 | 10/1998 |
| DE | 10 2005 008 705 | 9/2006 |
| DE | 10 2005 052 660 | 4/2007 |
| DE | 10 2008 016 989 | 10/2008 |
| EP | 0 972 102 | 12/2003 |
| EP | 2 151 517 | 10/2010 |
| WO | 2008/110582 | 9/2008 |

OTHER PUBLICATIONS

German Office Action conducted in counterpart German Appln. No. 10 2009 056 197.8 (Nov. 28, 2012) (with partial English language translation).

* cited by examiner

*Primary Examiner* — Amy Vanatta
(74) *Attorney, Agent, or Firm* — Greenblum & Bernstein, P.L.C.

(57) ABSTRACT

Method and device for producing a unidirectional (UD) layer with a predetermined layer width from a predetermined number of filament strands. The method includes spreading the filament strands out transversely to a longitudinal direction of the UD layer to form bands that are arranged next to one another. A first width of the bands is greater than a dividing width, which corresponds to the predetermined layer width divided by the predetermined number of filament strands.

10 Claims, 2 Drawing Sheets

DEVICE AND METHOD FOR PRODUCING A UD LAYER

CROSS-REFERENCE TO RELATED APPLICATIONS

The present application claims priority under 35 U.S.C. §119 of German Patent Application No. 10 2009 056 197.8, filed on Nov. 27, 2009, the disclosure of which is expressly incorporated by reference herein in its entirety.

BACKGROUND OF THE INVENTION

1. Field of the Invention

The invention relates to a method for producing a unidirectional or "UD" layer with a predetermined layer width from a predetermined number of filament strands, in which the filament strands are spread out to form bands transversely to the longitudinal direction of the UD layer and arranged next to one another.

Furthermore, the invention relates to a device for producing a UD layer with a predetermined layer width with a filament strand dispenser arrangement from which a predetermined number of filament strands can be drawn off simultaneously, a spreading device for each filament strand to spread out the filament strand transversely to its longitudinal direction to form a band, and a bobbin carriage for jointly winding up the spread out bands arranged next to one another.

The invention is described below based on the example of filament strands with carbon filaments. However, it is not restricted to carbon filaments.

2. Discussion of Background Information

Carbon filaments are sold in filament strands that contain 12,000, 24,000, 48,000 or more carbon filaments. The larger the number of carbon filaments, the more cost-effective the filament strands are in general. The filament strands have in cross section approximately the shape of an ellipse or a circle.

So-called UD layers are often required in the production of fiber-reinforced plastics. In a UD layer the fibers or filaments all are present in the same main direction. Although they do not have to be aligned exactly parallel to one another, they all run in the same direction. A fiber-reinforced plastic then has an increased tensile strength in this direction.

In order to be able to produce a UD layer of this type from the filament strands, the filament strands have to be arranged next to one another and spread out to form bands. The bands then present next to one another in one plane are then wound up jointly or jointly processed in another manner. Under some circumstances a transverse cohesion is produced between adjacent bands.

If increased tensile strengths in several directions are desirable in the subsequent plastic product with reinforcing fibers, then several UD layers with different fiber directions are laid one on top of the other and then embedded jointly into a plastic.

A method and a device of the type referenced at the outset are known, for example, from EP 0 972 102 B1.

DE 10 2005 008 705 B3 shows a device for feeding fiber bands to a knitting machine, in which the fiber bands are drawn off from bobbins at a uniform speed, but are further processed with predetermined stoppage times. During the stoppage times the fiber bands are temporarily stored in a controlled storage means.

From DE 10 2005 052 660 B3 a device and a method are known for spreading out a carbon fiber hank. In order to be able to better spread out the fiber hank, it is heated by conducting an electric current through it.

DE 197 07 125 A1 describes a method for producing unidirectional scrims, in which the spread out fibers are connected to one another by transverse connecting threads in order to form a web.

The spreading out of the filament strands to form the bands is simply carried out in that the filament strands are drawn with a certain tension over a deflection device, for example, a round rod. Due to the tensile stress, all of the filaments or fibers have the tendency to approach the rod. Filaments or fibers that are arranged closer to the rod are thereby displaced laterally outwards by the filaments or fibers arranged further away. A spreading of the filament strand to form the bands is automatically produced hereby.

However, it can be observed that a UD layer that is produced with bands of this type has a certain waviness or unevenness, in other words an irregular thickness, transversely to its longitudinal extension.

SUMMARY OF THE INVENTION

Accordingly, embodiments of the invention produce a UD layer with the most uniform possible thickness.

According to embodiments, a method of the type mentioned at the outset is provided in which the bands are spread out to form a band width that is greater than a dividing width, which results from the layer width divided by the number of filament strands.

In the following explanation the term "filaments" is used. However, the invention can also be used with fibers in the same manner.

It has hitherto been assumed that a UD layer with a predetermined layer width is produced in that all of the filament strands are spread out to the dividing width and then arranged next to one another. The dividing width is the layer width divided by the number of filament strands used. A UD layer with bands cohering or abutting transversely to the longitudinal direction is obtained with filament strands spread apart in this manner. It has now been established that although the spreading of the filament strands to form the bands is possible in a simple manner when they are drawn over a deflection device, a larger thickness of the band is produced where the filament strand was originally thicker, that is, generally in the center, than in regions where the filament strand was originally thinner. To put this in a simplified manner, over the width of the band a thickness distribution is produced that corresponds approximately to a flat bell curve. When bands of this type are now arranged next to one another, a certain waviness in the UD layer is thereby produced transversely to its longitudinal direction. If the bands are spread further apart than corresponds to the dividing width, although in principle initially the thickness curve of each individual band is not changed, a large number of possibilities are available for influencing the thickness curve of each band alone or the thickness curve of the UD layer in the transverse direction.

A first possibility is that the bands after the spreading are pushed together transversely to the longitudinal direction. The pushing together is carried out, for example, in that the bands are conducted through a guide that is narrower than the original band width. This guide acts mainly on the outer fibers of the band and displaces them inwards. The band center (seen in the transverse direction) is hardly influenced by the pushing together at all, however. Accordingly, an increase in thickness is produced at the longitudinal edges of the band without a corresponding increase in thickness in the center of the band.

It is hereby preferred that the bands are pushed together to a band width that corresponds to the dividing width. In this case, the bands arranged next to one another can be arranged in the transverse direction next to one another as it were without gaps in order to produce a UD layer with a closed surface.

In an alternative embodiment it is provided that the bands are pushed together to a band width that is smaller than the dividing width. In this case, smaller spaces result between the individual bands in the finished UD layer. This can be desirable in order to render possible the penetration by plastic when the UD layer is embedded in a plastic matrix. The spaces can be selected to be relatively small, for example, 0.1 to 1 mm.

In a further embodiment it can be provided that the bands are arranged transversely to the longitudinal direction in an overlapping manner. The overlapping arrangement can be carried out after the bands have been pushed together in the transverse direction. However, the overlapping arrangement can also be carried out without the bands being pushed together in the transverse direction. In this case, edge regions are respectively laid on top of one another which have a smaller thickness compared to the center of the band. In total then an approximately uniform thickness results over the width of the bands. The thickness can be adjusted even more exactly by pushing the bands together before the overlapping.

It is preferred hereby that the bands are spread out to a band width that is greater than the dividing width. Overlapping regions are then produced that in total have the desired thickness.

Preferably, bands with a changing width are produced during the pushing together. As stated above in connection with the device, in this manner when assembling the bands to form a fabric it can be ensured that gaps are produced between adjacent bands, through which gaps a plastic can later penetrate in order to form a fiber-reinforced plastic part. The width change can take place periodically, for example. Adjacent bands can then be arranged next to one another such that they abut against one another with their largest widths so that a gap remains in the fabric in the regions with a smaller width.

Preferably, the filament strands are spread out in at least two different planes. This then means that the filament strands do not impede one another during spreading. The filament strands can thus easily be spread out to a width that is greater than the dividing width. Even if the filament strands are spread out to a smaller width or are pushed together again laterally after the spreading to a greater width, it is advantageous if sufficient handling space is available for each filament strand or the band resulting therefrom.

According to embodiments, a device of the type mentioned at the outset is provided in which the spreading devices are divided into at least two groups. The groups are arranged at different positions and adjacent filament strands are guided by different groups.

With this embodiment it is possible to spread out the individual filament strands in the transverse direction beyond the dividing width that results from the layer width divided by the number of filament strands used. Because adjacent filament strands are spread out in different positions, the filament strands do not impede one another during spreading, instead they can spread out beyond the dividing width. After running through the spreading devices of the different groups, the individual bands then need only to be assembled in one plane or guided in another manner such that they can later can be wound up jointly.

It is preferred hereby that a calibration device is respectively connected downstream of at least some spreading devices, which calibration device pushes the band together transversely to its longitudinal direction to a predetermined width. As explained above in connection with the method, it is possible in this manner to standardize the thickness of a band. During the spreading of the filament strand to form the band, a bell-shaped curve of the thickness distribution is produced, i.e., the band is thicker in the center than at its edge regions. The calibration device now pushes the filaments in the region of the longitudinal edge in the direction of the center of the band again, so that the edge regions become thicker again, but the thickness in the center of the band remains virtually unchanged.

Preferably, the predetermined width is equal to a dividing width that corresponds to the layer width divided by the number of filament strands. In this case, a UD layer results in which the fibers are arranged next to one another without gaps.

In an alternative embodiment it is provided that the predetermined width is greater than the dividing width. In this case, the bands arranged adjacently overlap so that the sum of their edge regions is added. Even with thinner edge regions a thickness is then produced in total that corresponds much better to the thickness in the center of the band.

In a third alternative it can be provided that the predetermined width is smaller than the dividing width. In this case, in the subsequent UD layer gaps are produced in the transverse direction between the individual bands, which gaps render possible a penetration by plastic.

Preferably, the calibration device has a band width variation device. When the bands are pushed together transversely to their direction of feed, sections of the band can be produced thereby that have a larger width and sections that have a smaller width. When the individual bands are then arranged next to one another, gaps are produced in the fabric formed thereby, through which gaps plastic can later penetrate. This makes it easier to realize a penetration of the scrim by plastic. The band width variation device can be formed in different ways. If the calibration device has a rotating shaft with grooves, which ultimately define the width of the bands, then the width of the bands can be changed in a simple manner in that grooves are used that have a changing width in the circumferential direction. In this case, the width of the bands produced in this manner varies periodically. Another possibility lies in forming the calibration device by shoulder rings located on a shaft, between which shoulder rings the bands are guided through. A change in the width of the bands can be produced by a change in the axial position of the shoulder rings. The width change of adjacent bands can be coordinated with one another such that the bands abut against one another with their larger widths when they are arranged next to one another so that larger gaps are formed in the regions with smaller width.

Embodiments of the invention are directed to a method for producing a unidirectional (UD) layer with a predetermined layer width from a predetermined number of filament strands. The method includes spreading the filament strands out transversely to a longitudinal direction of the UD layer to form bands that are arranged next to one another. A first width of the bands is greater than a dividing width, which corresponds to the predetermined layer width divided by the predetermined number of filament strands.

According to embodiments of the invention, after the spreading, the method can further include pushing the bands transversely to the longitudinal direction. Further, the bands can be: transversely pushed to form a second band width corresponding to the dividing width; transversely pushed to form a second band width smaller than the dividing width; or pushed transversely to the longitudinal direction so that at least a portion of one band overlaps at least a portion of an other band. According to particular embodiments, the method can further include transversely pushing the bands to form a second band width that is still greater than the dividing width. In other embodiments, the method can also include transversely pushing the bands in a varying manner to form a band with a changing width.

According to still other embodiments of the instant invention, the spreading of filament strands can occur in at least two different planes.

Embodiments of the invention are directed to a device for producing a unidirectional (UD) layer with a predetermined layer width. The device includes a filament strand dispenser arrangement structured and arranged to substantially simultaneously draw off a predetermined number of filament strands, and at least one spreading device structured and arranged to spread out the predetermined number of filament strands transversely to their longitudinal direction to form bands. The spreading device includes at least two groups that are arranged at different positions so filament strands arranged adjacent to each other entering the spreading device are spread out by different groups.

According to embodiments, a bobbin carriage can be structured and arranged to jointly wind up the spread out bands arranged next to one another.

In accordance with other embodiments, the at least one spreading device may include a respective spreading device for each of the predetermined number of filament strands.

In accordance with further embodiments, a calibration device can be connected downstream of the at least one spreading device that is structured and arranged to push the band together transversely to its longitudinal direction to a predetermined width. Further, the predetermined width can be: equal to a dividing width corresponding to a layer width divided by the predetermined number of filament strands; greater than a dividing width corresponding to a layer width divided by the predetermined number of filament strands; or smaller than a dividing width corresponding to a layer width divided by the predetermined number of filament strands. According to particular embodiments, the calibration device may include a band width changing device.

Moreover, two rollers can be arranged to form a roller gap. The calibrated bands may be guided through the roller gap.

In accordance with still yet other embodiments of the present invention, the calibration device can include at least a first and second calibrating unit each having grooves and projections, and the grooves can correspond to the predetermined width. In particular embodiments, the grooves of the first calibrating unit can be arranged opposite the projections of the second calibrating unit, and the opposing grooves and projections can have a same length in a direction transverse to a running direction. In other embodiments, the grooves of the first calibrating unit can be arranged opposite the projections of the second calibrating unit, and a length of the grooves in a direction transverse to a running direction may be different from a length of the oppositely arranged projections in the direction transverse to the running direction.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
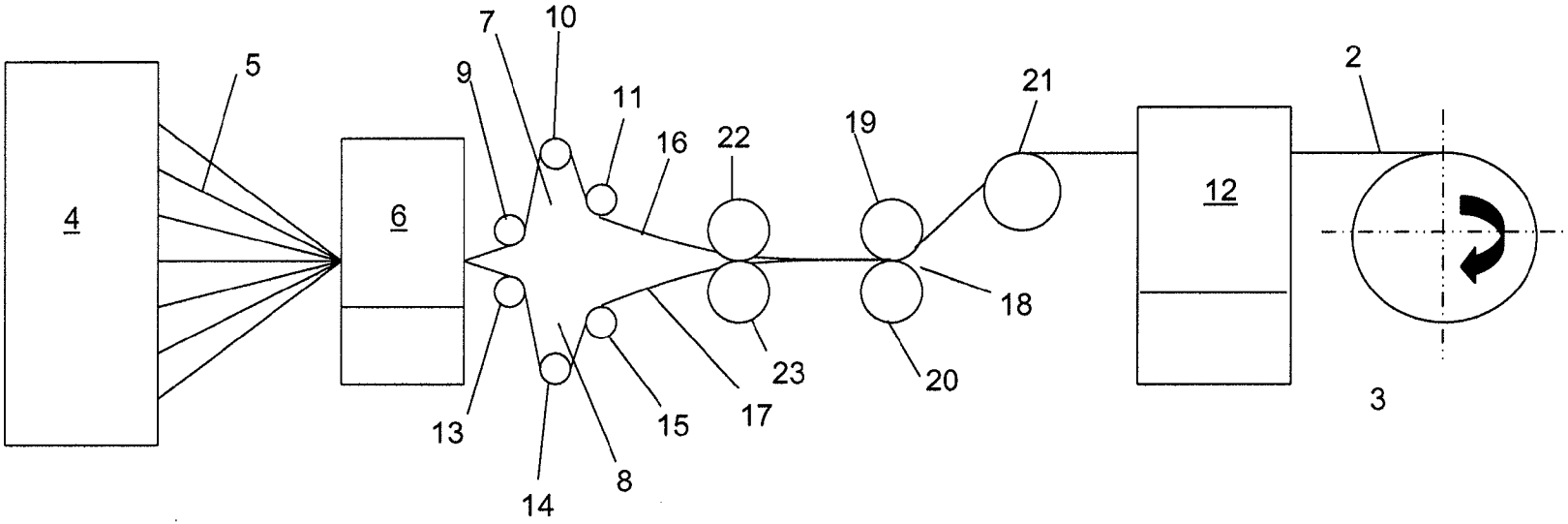
FIG. 1 illustrates a diagrammatic representation of a device for producing a UD layer and FIGS. 2*a*-2*c* illustrates different possibilities for adjusting adjacent bands.

FIG. 1 shows a device 1 for producing a UD layer 2, which is wound up on a lap 3. In a manner not shown in greater detail, adjacent windings can be separated from one another on the lap 3 by a separating paper or another separating means. Instead of a winding up, it is also possible to further process the UD layer 2 immediately, for example, in order to produce a multi-axial scrim or a fiber-reinforced plastic.

The device 1 has a filament strand dispenser arrangement 4. The filament strand dispenser arrangement 4 can be embodied, for example, as a creel in which a plurality of bobbins are arranged, wherein a filament strand is wound up on each bobbin. The filament strand dispenser arrangement can also have a plurality of barrels or boxes, wherein a filament strand is arranged in each barrel or box.

From the filament strand dispenser arrangement filament strands 5 are drawn off and guided through first feeder rolls 6. Expediently, the filament strands 5 are here arranged parallel next to one another.

A first group 7 of spreading devices and a second group 8 of spreading devices is arranged behind the feeder rolls 6 in the direction of feed of the filament strands 5. The spreading device 7 has three rods 9-11, over which the filament strands 5 are drawn with a predetermined tensile stress. The tensile stress is produced by second feeder rolls 12, which are arranged shortly before the lap 3.

The second group 8 of the spreading devices has three rods 13-15, over which the other filament strands 5 are drawn with the same tension. The same tension is produced in that all of the filament strands 5 are exposed to the tension that results depending on the tensile stress of the second feeder rolls 12.

The filament strands 5 are now guided such that adjacent filament strands 5 are alternately fed to the first group 7 and the second group 8 of the spreading devices. The spreading or expanding of adjacent filament strands 5 is thus carried out in different planes. It is thus possible to spread out the individual filament strands 5, as it were, independently of one another. In other words, the filament strands 5 can be spread out to form bands, the width of which is greater than a dividing width. The dividing width corresponds to the layer width of the finished UD layer 2 divided by the number of filament strands 5.

After running through the first group 7 or the second group 8 of spreading devices, the filament strands 5 are present in the form of bands 16, 17. These bands 16, 17 are now guided jointly through a nip 18 that is formed between two rollers 19, 20 and can also be referred to as a "roller gap." In the nip 18 the UD layer 2 is then formed, which can be deflected by a further deflector roll 22 and then guided through the second feeder rolls 12. Other guides are also possible.

Since the bands 16, 17 have a larger width than the dividing width, the bands 16, 17 overlap one another. The overlapping regions are pressed into one another in the nip 18 with a high tension. The nip 18 can also be omitted, if a tensile stress can be achieved in the bands 16, 17 in another manner at the roller 19, as a result of which tensile stress the edge regions of the bands 16, 17 are pressed into one another.

This approach results in the following advantage:

After running through the first group 7 or the second group 8 of the spreading devices, the bands 16, 17 have a thickness in their center (this is the center transverse to their direction of feed), which is somewhat larger than the thickness of the bands 16, 17 in their edge regions. This probably results from the fact that the filament strands 5 previously were likewise thicker in their center, and a complete thickness correction in the spreading devices cannot be realized at a reasonable expense. This means that the bands 16, 17 have a somewhat thicker center and thinner edge regions in the transverse direction. The thickness curve follows a type of "bell curve." This would lead to a correspondingly varying thickness in the finished UD layer 2, which in many cases is unfavorable. Through the overlapping of the thinner edge regions, however, thicknesses result in total that correspond to the thickness in the center of the bands 16, 17, so that the thickness of the UD layer can be kept uniform to a high degree. An absolute consistency of the thickness is not necessary in many cases.

After they have run through their respective spreading devices, the bands, 16, 17 can also be guided through calibration devices 22, 23. The calibration devices 22, 23 are shown diagrammatically in FIG. 2. In the simplest case, these are rods 24, 25, which have alternately full perimeter grooves 26, 27 and projections 28, 29.

When the band 16 is guided through the calibration device 22, then after leaving the calibration device 22 it has a width that corresponds to the distance between two projections 28*a*, 28*b*. In the same manner, a band 17 that runs through the calibration device 23 has a width that corresponds to a distance between two projections 29*a*, 29*b*.

The two calibration devices 22, 23 are respectively offset by a band width transversely to the direction of feed or longitudinal direction of the UD layer 2, so that a projection 28*a*, 28*b* is arranged approximately in the gap to a groove 27*a*, 27*b*.

Through a relative coordination of the width of the groove 27*a* to the width of the opposite projection 28*a*, different embodiments of the finished UD layer can now be produced.

Figures 2A, 2B, 2C:
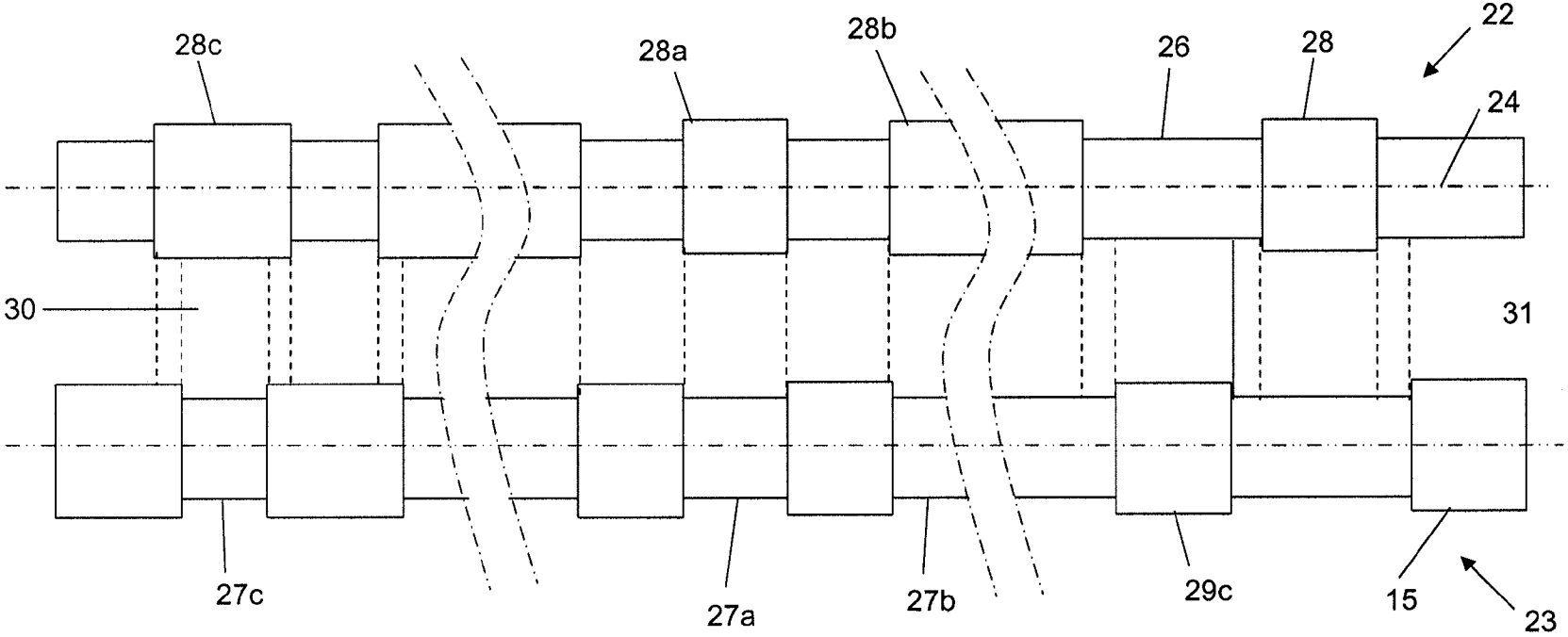

FIG. 2*a* shows a situation in which the groove 27*c* has a width that is smaller than the opposite projection 28*c*. Accordingly, a distance 30 transverse to the longitudinal direction results between adjacent bands 16, 17 after they have passed through the calibration devices 22, 23. This distance can be adjusted, for example, to a size in the range of 0.2 to 1 mm. In the UD layer 2 there is then the possibility for the plastic to penetrate through the UD layer.

FIG. 2*b* shows a situation in which the width of the groove 27*a* of the one calibration device 23 corresponds exactly to the width of the projection 28*a* in the other calibration device 22. Accordingly, a UD layer can be produced here in which the individual bands 16, 17 lie next to one another without gaps and without overlapping.

The thickness of the UD layer is nevertheless kept uniform in these two cases. It can namely be observed that the calibration devices 22, 23 act mainly on the filaments that are arranged in the edge regions of the bands 16, 17, and push these filaments in the direction of the center of the bands 16, 17. This results in a thickening of the bands 16, 17 in the edge regions. The center of the bands 16, 17 remains virtually unaffected by this displacement of the filaments in the edge regions, however.

FIG. 2*c* shows a situation in which the groove 26 has a larger width than the opposite projection 29*c*. Accordingly, an overlapping 31 results between adjacent bands 16, 17. Since the somewhat wider bands 16, 17 have here also been pushed together previously transversely to the longitudinal direction, the thickness of the edge regions can be adjusted relatively well such that the total of the thicknesses of the edge regions later corresponds to the thickness of the bands 16, 17 in the center thereof. A slightly larger thickness is hereby harmless.

If the grooves 26 of the calibration devices 23 are provided with a changing width in the circumferential direction, then bands 16, 17 are also produced with a width that changes continuously and periodically in the direction of feed. If the bands 16, 17 are later combined to form a fabric, then gaps or recesses are formed between adjacent bands 16, 17 in the regions of the bands 16, 17 that have a smaller width, through which gaps or recesses a plastic can later penetrate when a fiber-reinforced plastic element is produced. Alternatively to this, calibration devices 23 can also be used, in which the bands 16, 17 are guided between shoulder rings, the axial position of which can be changed. If the shoulder rings are pushed closer together, band regions with a smaller width are produced. If the shoulder rings are moved further apart, band regions are produced with a larger thickness. In every case the width variation is relatively slight. It is sufficient if the band width is changed by a few percent, for example, 3.5% or 10%.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A method for producing a unidirectional (UD) layer with a predetermined layer width from a predetermined number of filament strands, comprising:

spreading the predetermined number of filament strands out transversely to a longitudinal direction of the UD layer to form bands that are arranged next to one another, wherein a first width to which each band is spread is greater than a dividing width of the predetermined layer width, the dividing width being the predetermined layer width divided by the predetermined number of filament strands.

2. The method in accordance with claim 1, wherein after the spreading to the first width, the method further comprises pushing the bands having the first width transversely to the longitudinal direction.

3. The method in accordance with claim 2, wherein the bands having the first width are transversely pushed to form a second band width that corresponds to the dividing width.

4. The method in accordance with claim 2, wherein the bands having the first width are transversely pushed to form a second band width that is smaller than the dividing width.

5. The method in accordance with claim 2, wherein the bands having the first width are pushed transversely to the longitudinal direction so that at least a portion of one band overlaps at least a portion of an other band.

6. The method in accordance with claim 5, further comprising transversely pushing the bands having the first width to form a second band width that is still greater than the dividing width.

7. The method in accordance with claim 2, further comprising transversely pushing the bands having the first width in a varying manner to form bands with changing widths.

8. The method in accordance with claim 1, wherein the spreading of filament strands occurs in at least two different planes.

9. The method according to claim 1, wherein a sum of the first widths of the bands is greater than the predetermined layer width.

10. A method for producing a unidirectional (UD) layer with a predetermined layer width from a plurality filament strands, comprising:

spreading out the plurality of filament strands transversely to a longitudinal direction of the UD layer to form a plurality of bands positionable next to each other transversely to the longitudinal direction, wherein at least one the plurality of filament strands is spread out to form a respective band having a first width that is greater than a dividing width of the predetermined layer width, the dividing width being the layer width divided by the predetermined number of filament strands.

* * * * *